US007140206B2

(12) United States Patent
Braun et al.

(10) Patent No.: US 7,140,206 B2
(45) Date of Patent: Nov. 28, 2006

(54) GAP COVER DEVICE FOR SIDE-BY-SIDE APPLIANCES

(75) Inventors: John T. Braun, Vernon Hills, IL (US); Thomas M. Asher, Racine, WI (US)

(73) Assignee: Any Tech, Inc., Buffalo Grove, IL (US)

( * ) Notice: Subject to any disclaimer, the term of this patent is extended or adjusted under 35 U.S.C. 154(b) by 58 days.

(21) Appl. No.: 10/973,213

(22) Filed: Oct. 26, 2004

(65) Prior Publication Data

US 2006/0086157 A1 Apr. 27, 2006

(51) Int. Cl.
*D06F 39/00* (2006.01)

(52) U.S. Cl. ..... 68/3 R; 68/235 R; 134/201

(58) Field of Classification Search ..... 68/3 R, 68/235 R; 296/166; 277/189; 108/27; 134/201

See application file for complete search history.

(56) References Cited

U.S. PATENT DOCUMENTS 2,429,455 A * 10/1947 Dellon ..... 4/640
2,580,927 A * 1/1952 Kahn et al. ..... 126/37 R
2,599,322 A * 6/1952 Drain ..... 52/278
2,705,820 A * 4/1955 Torrence ..... 52/782.2
2,722,689 A * 11/1955 Uphues ..... 4/631
2,778,032 A * 1/1957 Meehan ..... 4/636
2,820,229 A * 1/1958 Opstad ..... 4/660
2,888,684 A * 6/1959 Icenhower ..... 52/716.1
3,154,357 A * 10/1964 Urbank et al. ..... 312/111
3,267,492 A * 8/1966 Jenkins ..... 4/660
3,351,615 A * 11/1967 Gordon ..... 528/256
3,376,861 A * 4/1968 Bach, Jr. ..... 126/37 R
3,392,720 A * 7/1968 Sherman ..... 126/211
3,446,201 A * 5/1969 More ..... 126/39 R
3,619,518 A * 11/1971 Blanch et al. ..... 191/12.2 R
3,822,858 A * 7/1974 Franklin ..... 249/194
3,837,134 A * 9/1974 DiFazio ..... 52/784.13
4,243,016 A * 1/1981 Kristen et al. ..... 126/211
4,723,583 A 2/1988 Lowe et al.
D356,192 S 3/1995 Wolff
5,411,164 A 5/1995 Smith et al.
5,437,492 A * 8/1995 Pascoe ..... 296/166
5,516,185 A * 5/1996 O'Donnell et al. ..... 296/166
5,518,309 A * 5/1996 St-Pierre ..... 312/140.4
D371,014 S 6/1996 Smith et al.
5,592,884 A 1/1997 Glick et al.
5,678,380 A * 10/1997 Azzar ..... 52/716.4
5,916,394 A * 6/1999 Prochaska et al. ..... 156/83
5,934,312 A 8/1999 Bellenger et al.
5,993,321 A 11/1999 Recknagel (Continued)

OTHER PUBLICATIONS

Sky Mall Brochure "Counter Kleen Seams Trim Kit" 2003.*

*Primary Examiner*—Frankie L. Stinson
(74) *Attorney, Agent, or Firm*—Levenfeld Pearlstein

(57) ABSTRACT

A gap cover device for covering a gap between clothes washer and dryer appliances having generally parallel juxtaposed sidewalls defining a gap between the appliances. The gap cover device includes a flexible elongated member having a generally T-shaped transverse cross-sectional configuration defining a gap spanning portion of sufficient transverse width to span the gap between the appliances, and an insert arm portion disposed generally normal to an underside of the gap spanning portion and adapted to be inserted into the gap. The insert arm portion has outwardly facing side surfaces at least one of which has a magnetic strip carried thereon operative to releasably secure the gap cover device to a selected one of the appliances to prevent objects from falling into the gap.

14 Claims, 2 Drawing Sheets

U.S. PATENT DOCUMENTS 6,063,475 A 5/2000 Ciancio et al.
6,082,841 A 7/2000 Smith et al.
6,386,378 B1 5/2002 Scharing
2002/0170553 A1* 11/2002 Grady ..... 126/220
2004/0129183 A1* 7/2004 Owen ..... 108/27

* cited by examiner

GAP COVER DEVICE FOR SIDE-BY-SIDE APPLIANCES

BACKGROUND OF THE INVENTION

The present invention relates generally to devices for closing a gap between adjacent spaced objects, such as juxtaposed clothes washer and dryer appliances, and more particularly to an inexpensive device for releasable mounting between such juxtaposed but spaced appliances to prevent articles from falling into a gap between the appliances.

It is a common practice in both home laundry facilities and commercial coin-op laundries to place a clothes washer appliance in juxtaposed or relatively close side-by-side relation with a dryer appliance, as is typical in home laundry facilities, or position clothes washers and/or dryers in rows of juxtaposed washers or dryers as typical in commercial coin-op facilities. In either case, the juxtaposed washer and dryer appliances are generally spaced apart sufficiently to enable articles of clothing or other objects to fall into a gap between the juxtaposed appliances, thereby requiring retrieval and often re-washing if damp clothes become soiled by being inadvertently dropped into the gap during transfer from the washer to the dryer. This problem is made more severe when a washer is positioned on a tray-like pad adapted to catch water that might leak out of the washer. The periphery of the tray pad usually extends outwardly from the periphery of the washer sidewalls thereby causing a larger than normal space or gap to be created between the juxtaposed appliances into which objects may drop. Accordingly, an inexpensive device adapted to be readily inserted between spaced juxtaposed appliances, such as clothes washers and dryers, at their upper surface levels so as to cover the gap created therebetween would overcome the aforedescribed problems.

BRIEF SUMMARY OF THE INVENTION

One of the primary objects of the present invention is to provide an inexpensive gap cover that can readily be placed on and between juxtaposed objects, such as clothes washer and dryer appliances, so as to cover a gap between the appliances and prevent objects from falling into the gap.

A more particular object of the present invention is to provide an inexpensive gap closer device for inserting into a gap created between spaced juxtaposed major appliances, such as a clothes washer and dryer pair, the gap closer device having a generally T-shaped transverse cross-section defining an elongated top cover member operative to span the gap and engage juxtaposed upper surfaces of the appliances, and having a depending arm for insertion into the gap to limit lateral movement of the gap closer device.

A feature of the gap closer device in accordance with the invention lies in providing magnetic means on at least one exposed surface of the depending arm for releasably adhering to an adjacent appliance so as to retain the gap closer device in relatively fixed position when closing a gap between a pair of appliances.

Another feature of the gap closer device in accordance with the present invention is the ability to make the device by extrusion techniques, preferably of a flexible polyvinyl chloride, with the result that a strong yet flexible elongated gap closure can be achieved economically.

Further objects, features and advantages of the invention will become apparent from the following detailed description when taken in conjunction with the accompanying drawings wherein like reference numerals designate like elements throughout the several views. While the present invention is susceptible of various modifications and alternative forms, specific embodiments thereof are shown by way of example in the drawings and will herein be described in detail. It should be understood, however, that the drawings and detailed description are not intended to limit the invention to the particular form disclosed, but rather are intended to cover all modifications, equivalents and alternatives falling with the spirit and scope of the invention.

DETAILED DESCRIPTION OF THE INVENTION

Figure 1:
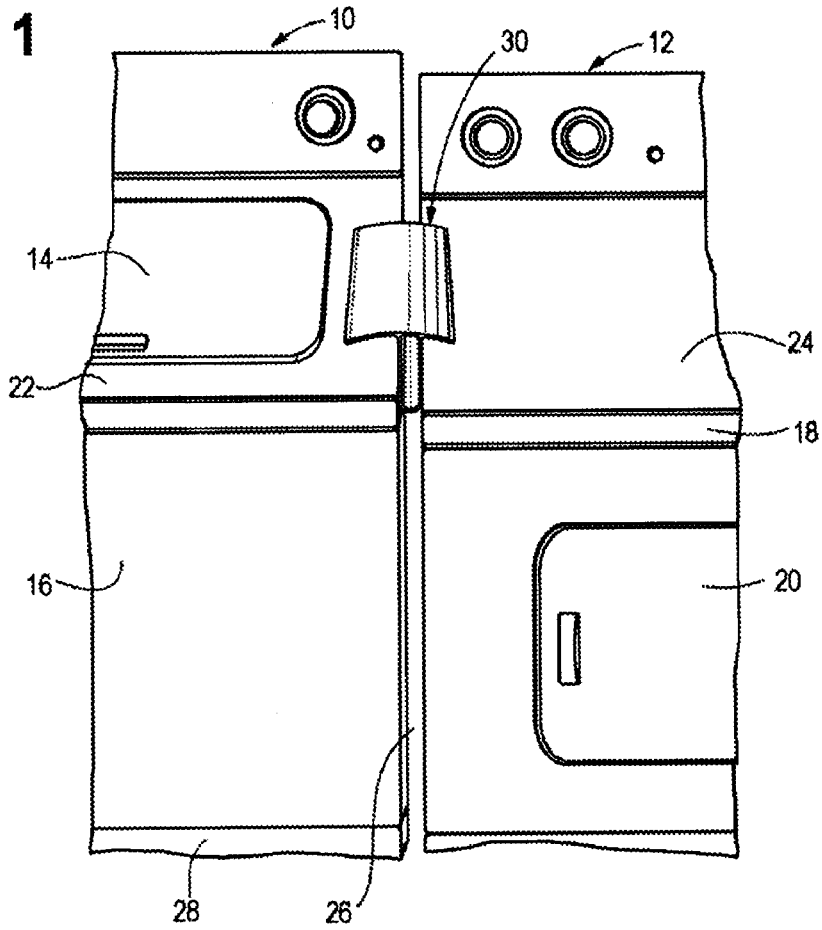
FIG. 1 is a fragmentary perspective view illustrating portions of clothes washer and dryer appliances disposed in juxtaposed spaced relation so as to create a gap therebetween, and having a gap closer device in accordance with the present invention closing the gap so as to prevent objects from falling into the gap.

Referring now to the drawings, and in particular to FIG. 1, a fragmentary portion of a clothes washer appliance of the type generally used in home laundry facilities is indicated generally at 10. The clothes washer appliance 10 is positioned in juxtaposed or side-by-side relation with a clothes dryer appliance, a fragmentary portion of which is indicated generally at 12, that is also of the type conventionally utilized in home laundry facilities. The clothes washer 10 has a hinged top loading access lid or door 14 and a generally rectangular housing including a vertically disposed front wall or panel 16 formed integral with otherwise suitably secured at its vertical marginal edges to sidewall panels as is known. Similarly, the clothes dryer 12 has a generally rectangular housing including a vertical front panel 18 to which a front access door 20 is hinged to facilitate insertion of damp or washed clothing into the dryer from the washer. Clothes washer and dryer appliances are generally of equal height so that their upper rectangular planar surfaces, indicated at 22 and 24, respectively, are substantially coplanar and have marginal edges disposed in juxtaposed or side-by-side relation.

As aforedescribed, it is a conventional practice in both home laundry facilities and commercial coin-op clothes washer and dryer facilities to place a pair of washer and dryer appliances in juxtaposed or relatively close side-by-side relation, or in a row of dryers or washers as frequently the case in commercial do-it-yourself coin-op laundries. Because during operation, both the washer and dryer may be subjected to vibration, it is a common practice to space the appliances so that a gap 26 is formed between the juxtaposed appliances of sufficient width to prevent the appliances from rubbing or engaging each other during operation.

It is also frequently desirable to position the washer on a rectangular tray-like base, as indicated at 28 in FIG. 1, so as to catch any water that may leak from the washer. As a result, an upstanding peripheral lip or marginal edge on the tray/ base generally extends outwardly from the periphery of the washer sidewalls. This necessitates that the washer and dryer appliances be spaced farther apart more than might otherwise be the case in order to accommodate the tray-like base or pan 28. As a result, the gap 26 formed between the juxtaposed washer and dryer appliances is generally of sufficient width that objects may be inadvertently be dropped into the gap with the result that the objects must be retrieved. This is particularly troublesome when clothes items are dropped into the gap while being transferred from the washer to the dryer inasmuch as any clothing or the like dropped into the gap may become soiled and thereby necessitate re-washing.

Figure 2:
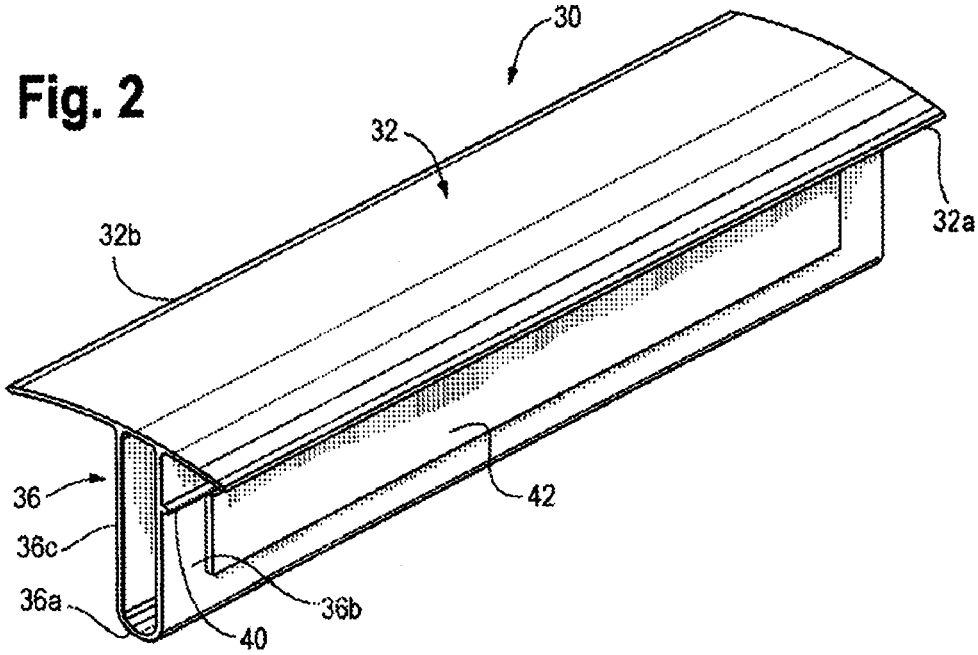
FIG. 2 is a perspective view of the gap closer device of FIG. 1.
Figure 3:
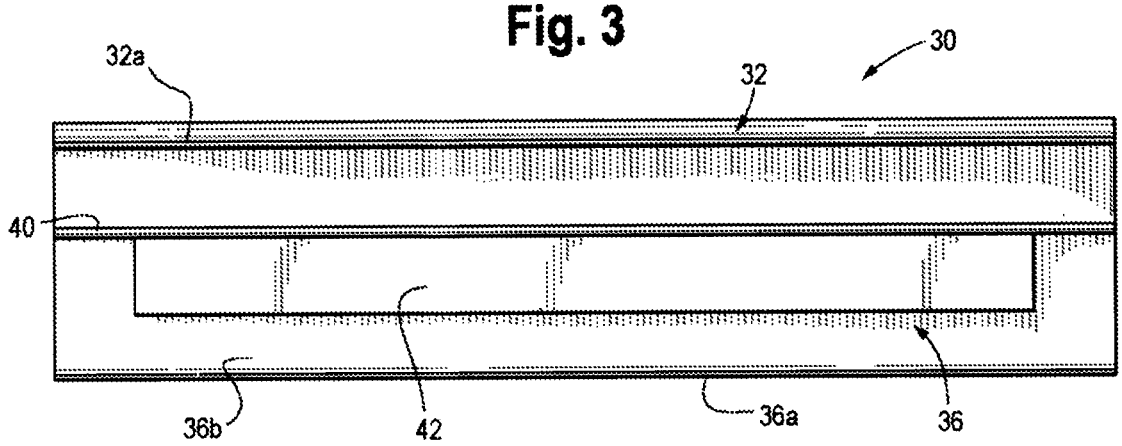
FIG. 3 is a side elevational view of the gap closer device of FIG. 2.
Figure 4:
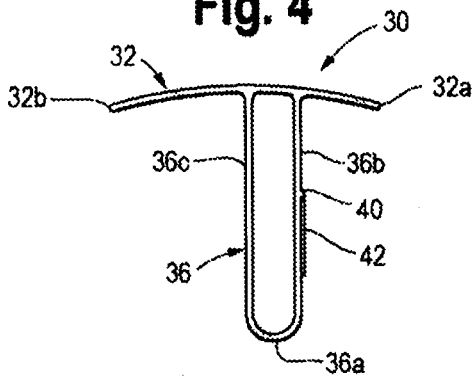
FIG. 4 is an end elevational of the gap closer device of FIG. 2.

In accordance with the present invention, a gap cover device, one embodiment of which is indicated generally at 30 in FIGS. 2–4, is provided to close the gap 26 between juxtaposed or spaced side-by-side appliances, such as the washer 10 and dryer 12. As illustrated in FIG. 1, the gap closer device 30 is adapted to be inserted into the gap 26 formed between the washer and dryer so as to span the gap and prevent objects from being inadvertently dropped into the gap.

The gap cover device 20 is formed as a flexibly elongated member having a generally T-shaped transverse cross-sectional configuration as shown in FIG. 4. The gap cover device 30, which may be termed a gap cover, has a gap spanning portion 32 that is of generally rectangular configuration as viewed in plan, and has a generally arcuate configuration when viewed in transverse section or in end elevation as in FIG. 4. The gap spanning portion 32 thereby defines a convex upper surface that may have a predetermined radius and extends between longitudinal laterally spaced marginal edges 32*a* and 32*b*. The gap spanning portion 32 has a transverse width, considered as the distance between the longitudinal marginal edges 32*a,b*, sufficient to enable the longitudinal marginal edges to engage the upper generally horizontal surfaces 22 and 24 of the washer and dryer appliances as illustrated in FIG. 1. To this end, the transverse width of the gap spanning portion 32 is preferably made of sufficient transverse width to cover a gap width or space of upwards of approximately 3.5".

The gap closer device 30 includes an insert arm portion 36 that is preferably formed integral with or otherwise suitably secured to the underside of the gap spanning portion 32 so as to extend downwardly therefrom in generally normal relation to a plane contacting the longitudinal marginal edges 32*a* and 32*b* of the span closing portion. As illustrated in FIG. 4, the insert arm portion 36 depends from the gap spanning portion 32 at a position laterally offset from the longitudinal center of the gap spanning portion. The insert arm portion 36 preferably extends downwardly from the gap spanning portion 32 a distance of at least approximately 3", and has a transverse width of approximately 0.75". The lower end of the insert arm 36 is preferably rounded at 36*a*.

In accordance with one feature of the gap closer device 30, it can be formed by conventional extrusion techniques and is preferably formed of a flexible polyvinyl chloride (PVC). In this manner, the insert arm portion 36 may be formed as a hollow arm portion having parallel sidewalls 36*b* and 36*c* the upper marginal edges of which are formed integral with the gap spanning portion 32, and the lower marginal edges of which are formed integral with the curved lower end 36*a*. It will be understood that the gap closer device 30 may also be formed from other suitable flexible polymeric materials or PET.

A selected one of the insert arm walls 36*b* or 36*c*, preferably wall 36*b*, has a longitudinally extending bead or outward projection 40 formed thereon, such as during an extrusion process, so that the bead extends the length of the gap closer device preferably approximately mid-height of wall 36*b*. An elongated generally rectangular adhesive backed magnetic strip 42 is secured to the exterior surface of the insert arm wall 36*b* so that an upper marginal edge of the magnetic strip abuts or is spaced slightly below the longitudinal bead or projection 40 on the insert arm portion 36. The magnetic strip 42 may be formed as a continuous strip extending substantially the length of the gap closer device 30 or may be formed as a number of shorter length magnetic strips.

It will be appreciated that the gap closer device 30 may be mounted between the clothes washer and dryer appliances 10 and 12 so that the insert arm portion 36 extends into the gap 26, and the gap spanning portion 32 spans or covers the gap with the longitudinal marginal edges 32*a* and 32*b* of the gap spanning portion engaging the upper surfaces 22 and 24 of the juxtaposed washer and dryer. When so installed, the magnetic strip 42 magnetically adheres to an opposed upstanding sidewall of either the washer or dryer, depending on the orientation of the gap closing device when inserted into the gap, so as to maintain the gap closer device within the gap irrespective of vibration of the appliance to which it is magnetically attached.

Figure 5:
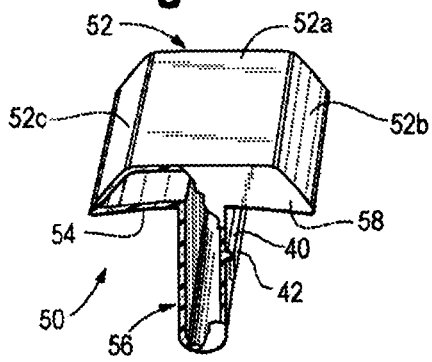
FIG. 5 is a perspective view illustrating an alternative embodiment of a gap closer device in accordance with the present invention.

FIG. 5 illustrates an alternative embodiment of a gap closer device, indicated generally at 50, that is generally similar to the aforedescribed gap closer device 30. The gap closer device 50 may be also be made of an extruded flexible plastic, such as flexible polyvinyl chloride, to define a gap spanning portion 52 having a generally flat upper surface 52*a* with longitudinal marginal edges formed integral with generally convexly curved outer longitudinal surface portions 52*b* and 52*c*. The outer marginal edges 52*b,c* are formed integral with a generally planar wall portion 54 to which an insert arm 56 is formed during an extruding process so that the gap closer device 50 is formed as an elongated flexible generally hollow and lightweight gap closer device with the gap spanning portion 52 operative to overlie and close a gap, such as 26, formed between two juxtaposed but spaced appliances and with the depending leg portion 56 extending into the gap. The depending leg portion has a similar elongated adhesively secured magnetic strip 42 applied to a selected one of the outer exposed surfaces of the arm insert adjacent a longitudinal extending bead or projection 58 similar to bead 40 on the gap closer device 30. Generally T-shaped end plates or covers, one of which is indicated at 58 in FIG. 5, may be applied to the opposite ends of the hollow gap closer device 50. If desired, the gap closer device 50 could be formed as a flexible solid extruded plastic gap closer.

Having described two alternative embodiments of a gap closer device in accordance with the present invention, it will be appreciated that an economical and lightweight gap closer device is provided that may be readily inserted into a gap between appliances so as to close or cover the gap between the appliances and thus prevent inadvertent dropping of objects into the gap. While preferred embodiments of the invention have been illustrated and described, it will be understood that the changes and modifications may be made therein without departing from the invention in its broader aspects. Various features of the invention are defined in the following claims.

What is claimed is:

1. A gap cover device for use in covering a gap between two appliances having generally parallel juxtaposed edges lying in a generally horizontal plane and defining a gap between the juxtaposed edges, said gap cover device comprising a flexible elongated member having a substantially T-shaped transverse cross-sectional configuration defining a gap spanning portion of sufficient transverse width to engage said juxtaposed edges and span the gap therebetween, and an insert arm portion disposed generally normal to an underside of said gap spanning portion and adapted to be inserted into the gap, said insert arm portion defining a pair of longitudinally extending parallel spaced sidewalls at least one of which has a longitudinal outwardly extending ridge formed on a outer exposed surface thereof at approximately midway between opposite longitudinal margins thereof the, gap cover device including a magnetic strip being mounted on said one sidewall adjacent said ridge, spaced from the gap spanning portion to to releasably secure the cover device in position covering the gap so as to prevent objects from falling into the gap.

2. A gap cover device as defined in claim 1 wherein the cover device is made from a flexible plastic.

3. A gap cover device as defined in claim 2 wherein the cover device is made of flexible polyvinyl chloride.

4. A gap cover device as defined in claim 1 wherein the cover device is made from extruded flexible polyvinyl chloride.

5. A gap cover device as defined in claim 1 wherein said magnetic strip is mounted on said one sidewall between said ridge and a marginal edge of said one sidewall spaced from the gap spanning portion.

6. A gap cover device as defined in claim 5 wherein said ridge extends outwardly from said one sidewall a distance generally equal to the thickness of the magnetic strip.

7. A gap cover device as defined in claim 1 wherein said gap spanning portion defines a convex outer exposed surface when the gap cover device is disposed in a gap covering position between two juxtaposed appliances.

8. In a clothes washer and dryer appliance system including a pair of washer and dryer appliances having generally equal height upstanding sidewalls disposed in juxtaposed generally parallel relation and defining a gap therebetween into which objects may fall, the combination therewith comprising a removable elongated gap closer member made of a flexible plastic material and having a generally T-shaped transverse cross-sectional configuration defining an elongated cover plate of sufficient transverse width to span the gap and rest on upper margins of said juxtaposed sidewalls, said gap closer member having an insert arm formed integral with or secured in normal relation to an underside of the cover plate and adapted to be inserted into the gap, said insert arm including a pair of longitudinally extending parallel spaced sidewalls at least one of which has a longitudinal outwardly extending ridge formed on a outer exposed surface thereof at approximately midway between opposite longitudinal margins thereof, said gap closure device including magnetic means mounted on said one sidewall adjacent said ridge spaced from the cover plate for releasable magnetic attachment to a selected one the appliance upstanding sidewalls.

9. The clothes washer and dryer appliance system as defined in claim 8 wherein the gap closer member is made from a flexible plastic.

10. The clothes washer and dryer appliance system as defined in claim 9 wherein gap closer member is made of flexible polyvinyl chloride.

11. The clothes washer and dryer appliance system as defined in claim 8 wherein said gap closer member is made from extruded flexible polyvinyl chloride.

12. The clothes washer and dryer appliance system as defined in claim 8 wherein said magnetic means comprising a magnetic strip mounted on said one sidewall between said ridge and a marginal edge of said one sidewall spaced from the cover plate.

13. The clothes washer and dryer appliance system as defined in claim 12 wherein said ridge extends outwardly from said one sidewall a distance generally equal to the thickness of the magnetic strip.

14. The clothes washer and dryer appliance system as defined in claim 8 wherein said gap spanning portion defines a convex outer exposed surface when the gap closer member is disposed in a gap covering position between two juxtaposed appliances.

* * * * *